United States Patent [19]

Malik

[11] 4,005,816

[45] Feb. 1, 1977

[54] MAILBOX HAVING DUAL ACCESS CLOSURES AND SIGNAL MEANS

[76] Inventor: Joseph M. Malik, 818 S. Big A Road, Toccoa, Ga. 30577

[22] Filed: May 12, 1976

[21] Appl. No.: 685,765

[52] U.S. Cl. ..... 232/35; 232/17

[51] Int. Cl.[2] ..... B65D 91/00

[58] Field of Search ..... 232/17, 34, 35

[56] References Cited

UNITED STATES PATENTS

| | | | |
|---|---|---|---|
| 1,562,536 | 11/1925 | Berg | 232/34 |
| 1,990,003 | 2/1935 | Schlenker | 232/35 |
| 2,480,469 | 8/1949 | Horn | 232/35 |
| 3,106,335 | 10/1963 | Allan | 232/17 |
| 3,589,329 | 6/1971 | Schuh | 232/35 R |

*Primary Examiner*—James T. McCall
*Assistant Examiner*—Peter A. Aschenbrenner
*Attorney, Agent, or Firm*—Patrick F. Henry

[57] ABSTRACT

Each of the opposite ends of a basically conventional mailbox is provided with a hinged closure which operates a signal device which is pivoted on the side of the mailbox so as to be elevated by the opening of the entry or deposit end of the box and to be lowered upon the opening of the exit or removal end of the mailbox. The entry closure operates a spring mounted rod to lift the signal device and the exit closure operates a small chain to drop the signal device back to its normal lowered position.

14 Claims, 5 Drawing Figures

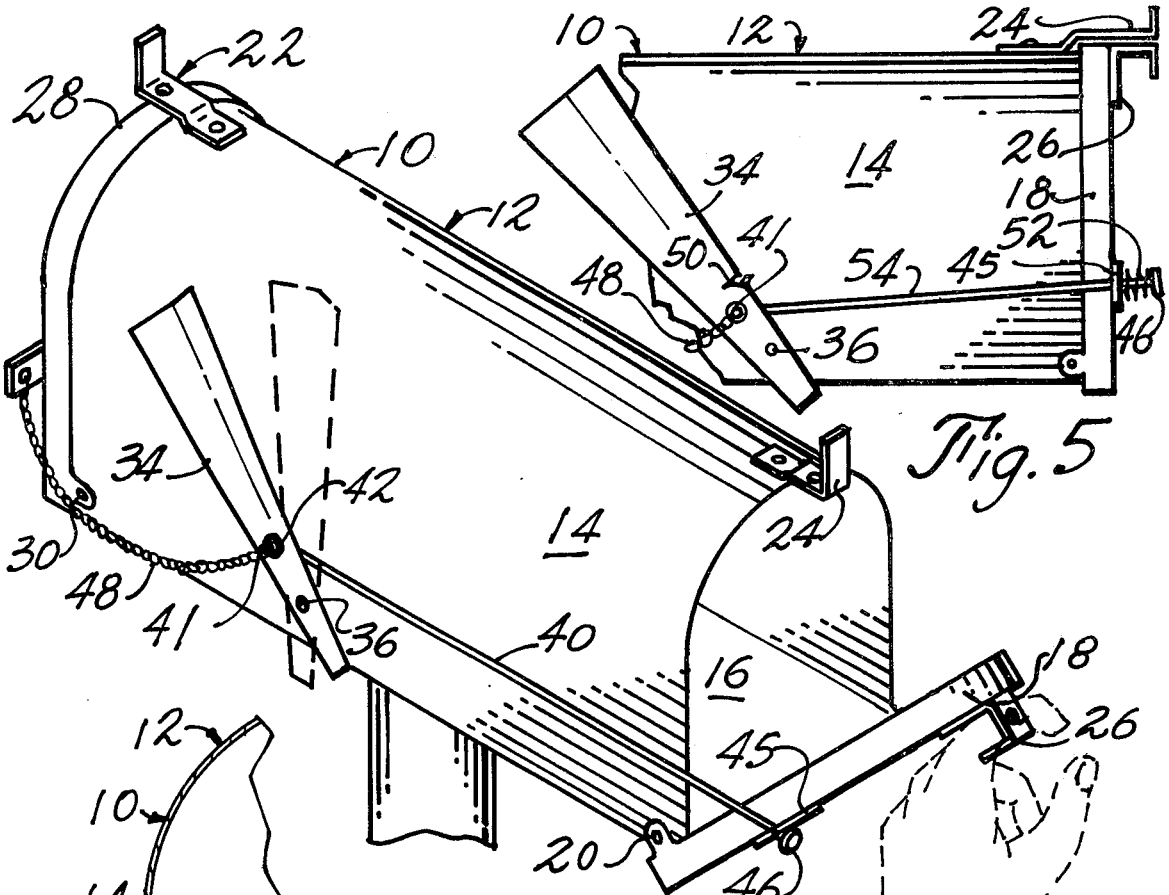
Fig. 5
Fig. 1
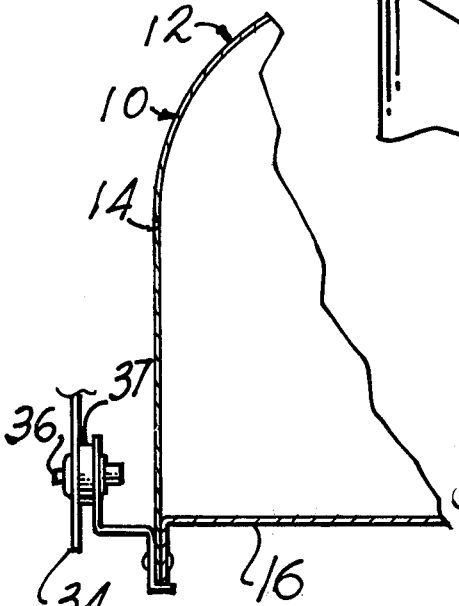
Fig. 2
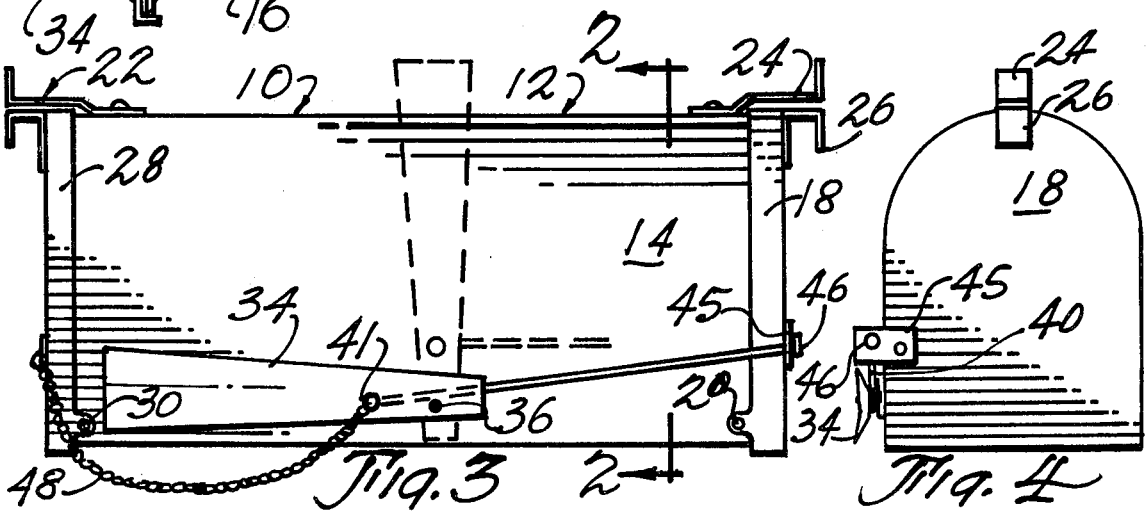
Fig. 3
Fig. 4

MAILBOX HAVING DUAL ACCESS CLOSURES AND SIGNAL MEANS

BACKGROUND OF THE INVENTION

1. Field of the Invention

Deposit and collection receptacles. Signals and indicators for deposit and collection receptacles.

2. Description of the Prior Art

The prior art, of course, includes ordinary rural mailboxes which include a small flag which has to be manually operated usually by the owner of the mailbox to indicate that there is outgoing mail to be picked up. This flag is not very visible to the occupant of a dwelling which has the mailbox out front. There are also signal devices for mailboxes which are actuated by the opening of the front or mail-entry door but these devices must be preset by the owner in conjunction with the closing of the front or entry door to the mailbox, and such mailbox arrangements require the contents to be removed from the front in the usual fashion. The present arrangement provides a mailbox having both a front entry door for the insertion of the mail and a rear entry door for the removal of the mail without stepping into the street or road. In addition, there is a signal means which is operated by the opening and closing of the front and rear door so as to indicate that the front door has been opened.

SUMMARY OF THE INVENTION

A mailbox having a front deposit door and a rear removal door, a signal means mounted on said mailbox for actuation to elevated and signaling position by the opening of the front door and to be lowered by the opening of the rear removal door, and a means for operating said signal means.

In one form the present invention employs the foregoing arrangement together with an actuating rod connected between the signal means and the front door and a member connected between the rear door and the signal means for lowering same.

An advantage of the present invention is in a provision of both a rear removal door so that the contents can be removed without stepping into the road or street plus the automatic actuation for raising and lowering the signal means in response to the normal operation of the front door whenever mail or other articles are left in the box and for the removal thereof from the rear door.

Other and further objects and advantages will appear from reading the foregoing information together with the accompanying description with reference to the drawings.

BRIEF DESCRIPTION OF THE DRAWING

FIG. 1 is a perspective view of a mailbox constructed in accordance with the present invention and illustrating the opening of the front door and the raising of the signal device.

FIG. 2 is a cross-sectional view taken along lines 2—2 in FIG. 3.

FIG. 3 is a side elevation view of the mailbox shown in FIG. 1 with both closures in closed position and the signal device lowered in full lines and raised in dotted lines.

FIG. 4 is a front elevation view looking from right to left into the end of the mailbox shown in FIG. 3.

FIG. 5 is a side elevation view of an optional construction using a coil spring and stop member.

DESCRIPTION OF THE PREFERRED EMBODIMENT

The complete mailbox arrangement is referred to by reference numeral 10 and it comprises the usual conventional mailbox housing or body designated generally by reference numeral 12 having a curved housing 14 and a flat bottom 16 attached together in one rigid assembly. There is a front closure or door 18 mounted on small pivot pins 20 on opposite sides of the housing 14 and including a spring latch arrangement of conventional construction comprising a spring latch tongue 24 attached to the housing and a small plate 26 mounted on the front closure 18 which latches into place. An identical construction is found in the rear door designated generally by reference numeral 28 which is mounted on small pivot pins 30 and held in place by the same sort of spring latch arrangement 22. Thus, mail or other articles inserted into the mailbox 10 by opening the front door 18 from the street or road, as when the postman delivers the mail, may be removed without entering into the street or road by opening the rear door 28.

A signal means is provided in the present device as mentioned previously in order to signal the occupant or owner of the mailbox know that the mail has been delivered or that the front closure 18 has been opened. The signal means comprises a large red signal element 34 of elongated plate construction from lightweight sheet metal, plastic or the like pivoted to the housing 14 on a small pivot pin 36 on which there is a fibre washer 37 which holds the element 34 in up, signal position by means of a resilient tight fitting between pin 36 and housing 14 thru washer 37, thus permitting the signal element 34 to be raised from the lowered or almost horizontal position shown in FIG. 3 to an elevated or almost vertical position shown in the dotted lines of FIG. 3 as well as the dotted lines of FIG. 1. The elevation of the signal element 34 may be accomplished automatically upon opening the front door 18 by means of a long actuating member 40 in the form of a thin rod having one bent end 41 inserted and attached to the signal element 34 in a hole 42 whereby the bent end 41 of the rod will move in the hole 42 in the signal element 34 as it is raised from horizontal to vertical position and vice versa, and the other end 43 of member 40 inserted thru a hole 44 in a small plate 45 projecting from door 18 and held in place by a nut 46.

A flexible member such as a chain 48 has one end attached to the rear door 28 and the other end attached to the lower portion of the signal element 34. Chain 48 also serves as a stop for or limit to the travel of the signal element 34 preventing it from falling toward door 18, in the absence of any other stop.

In the operation of the device, it is noted that the length of the rod 40 is calculated so that the signal element 34 will lie substantially in horizontal position shown in FIG. 3 when the front door 18 is closed but upon opening door 18 the rod 40 will pull the signal element 34 to the vertical position by means of plate 45 bearing on nut 46 upon movement of the door 18. An optional stop member 50 is a small tab bent from the signal element 34 to engage rod 54 in maximum up position to stop the signal element 34 in its substantially vertical position shown in FIGS. 1 and 3; however, the friction washer 37 will bind sufficiently to hold the signal element 34 in vertical position.

Optionally as seen in FIG. 5 there may be a spring 52 acting like a shock absorber permitting some relative motion between a longer rod 54 when the door 18 swings open.

After the front door 18 has been opened to insert the mail thereby raising the signal element 34 to elevated condition, the front door 18 may be closed leaving the rod 40 in extended condition or it may be left partly open. Upon opening the rear door 28 to remove the mail the length of chain 48 is such that the signal element 34 is pulled or slightly jerked to return it to its lowered almost horizontal position thereby closing the front door 18 and since the chain 48 is flexible the rear closure 28 may be again closed leaving the mailbox in the condition shown in FIG. 3.

While I have shown and described a particular embodiment of this device and ascribed a particular mode of operation this is by way of illustration and does not constitute any sort of limitation on the scope of the invention since various alterations, changes, deviations, eliminations, amendments, and revisions may be made in the embodiment shown without departing from the scope of my invention as defined in the appended Claims.

What is claimed:

1. In a mailbox construction: an elongated mailbox housing, a front closure movably mounted on one end of said housing for depositing articles therein, a rear, closure movably mounted on the other end of said housing for removing articles placed in said mailbox, a signal device on said mailbox movable from a non-signalling position to a signalling position, and means connected to said front closure for moving said signal means from a non-signaling to a signaling position upon movement of said front closure and other means connected to said second closure for returning said signal means to non-signaling position upon the opening of said second closure.

2. The device claimed in claim 1 wherein said means connected to said first closure for moving said signaling means to a signaling position comprises an actuating member connected from said front closure to said signaling member.

3. The device claimed in claim 2 wherein said means connected to said rear closure for moving said signaling means to non-signaling position is a second actuating member connected between said second rear closure and said signaling means.

4. The device in claim 1 wherein said means connected to said first closure is an actuating rod having one end connected to said signal device and the other end to said front closure.

5. The device in claim 4 wherein said rod extends beyond said front closure when said closure is closed and there is a spring means interposed between said rod and said closure.

6. The device in claim 1 wherein said means connected to said second closure is a flexible member such as a chain.

7. The device in claim 4 wherein said means connected to said second closure is a flexible member such as a chain

8. The device in claim 1 wherein there is a stop member on said signal device.

9. In a mailbox construction: a mailbox housing having a front end and a rear end and a bottom therein, a front closure for said front end on said housing movable from an open to a closed position, a rear closure on said rear end of said housing movable from an open to a closed position, a signal element on said housing comprising an elongated signal member pivotally mounted on one side of said housing and being movable from a substantially horizontal non-signaling position to a substantially vertical signaling position, an actuating means between said front closure and said signaling member comprising an elongated member having one end connected to said front closure and the other end connected to said signaling member, and a second actuating member for returning said signaling device to non-signal position and having one end attached to said signaling member and the other end attached to said second closure whereby the opening of said second closure will move said signaling member to non-signaling position.

10. The device claimed in claim 9 wherein said actuating means is a rod member extending thru and beyond said front closure, and a coil spring interposed in place on said rod member and bearing against said front closure.

11. The device claimed in claim 9 wherein said signal element is pivotally mounted on one side of said housing, a pivot pin having said signal element mounted thereon, and a fibre washer interposed between said housing and said signal element, there being sufficient tight fitting and pressure between said pin and said washer to provide a resilient tight fit whereby said signal element tends to remain in whatever position it is brought to.

12. The device in claim 9 wherein said actuating means is a rod member having one end connected to said signal element and the other end connected to said front closure, a flexible member such as a chain having one end connected to said rear closure and the other end connected to said signal element whereby said flexible member pulls on said signal element upon the opening of said rear closure to return said signal element to normal non-signaling position.

13. The device claimed in claim 12 wherein there is a stop member on said signal element engageable with said actuating means to positively stop the movement of said signal element beyond a predetermined approximate vertical position.

14. The device claimed in claim 4 wherein said rod member has one end mounted in an opening in said signal element for a relative motion therebetween and the other end thereof loosely mounted in said front closure for limited relative motion therebetween.

* * * * *